US010001086B2

(12) United States Patent
Hutchinson et al.

(10) Patent No.: US 10,001,086 B2
(45) Date of Patent: Jun. 19, 2018

(54) CARBURETOR WITH THROTTLE SHAFT RETAINER

(71) Applicant: USA ZAMA INC., Franklin, TN (US)

(72) Inventors: Mark A. Hutchinson, Franklin, TN (US); Jay A. Perry, West Point, TN (US)

(73) Assignee: USA ZAMA, INC., Franklin, TN (US)

( * ) Notice: Subject to any disclaimer, the term of this patent is extended or adjusted under 35 U.S.C. 154(b) by 88 days.

(21) Appl. No.: 15/162,981

(22) Filed: May 24, 2016

(65) Prior Publication Data

US 2016/0369747 A1 Dec. 22, 2016

Related U.S. Application Data

(60) Provisional application No. 62/181,585, filed on Jun. 18, 2015.

(51) Int. Cl.

| | |
|---|---|
| ***F02M 9/00*** | (2006.01) |
| ***F02M 9/02*** | (2006.01) |
| ***F02M 9/08*** | (2006.01) |
| ***F02M 19/00*** | (2006.01) |

(52) U.S. Cl.
CPC ..... *F02M 9/02* (2013.01); *F02M 9/08* (2013.01); *F02M 19/00* (2013.01)

(58) Field of Classification Search
CPC ..... F02M 9/02; F02M 9/08; F02M 1/02
USPC ..... 261/64.1
See application file for complete search history.

(56) References Cited

U.S. PATENT DOCUMENTS 6,708,959 B1 * 3/2004 Dow ..... F02M 17/04 261/65

* cited by examiner

*Primary Examiner* — Robert A Hopkins
(74) *Attorney, Agent, or Firm* — One LLP

(57) ABSTRACT

A carburetor with throttle shaft retainer system. The throttle shaft retainer system employs a retainer member in the form of a retainer pin or retainer clip that is pressed into the body of the carburetor to engage a retainer groove formed about or partially about the circumference of the throttle shaft. The interaction between the retainer member and the retainer groove prevents movement in the axial direction of the throttle shaft. With certain drilling and machined cuts to the throttle shaft, the retaining pin acts as the wide-open-throttle (WOT) stop when the throttle is rotated to a WOT position.

5 Claims, 8 Drawing Sheets

CARBURETOR WITH THROTTLE SHAFT RETAINER

CROSS-REFERENCE TO RELATED APPLICATION

The subject application claims the benefit of U.S. Provisional Application No. 62/181,585, filed Jun. 18, 2015, which application is incorporated herein by reference.

FIELD

The embodiments described herein relate to a carburetor and, more particularly to a carburetor with a throttle shaft retainer.

BACKGROUND

Most carburetors on small internal combustion engines control engine speed with a throttle valve. The valve is mounted to a throttle shaft. Carburetors using a throttle valve (butterfly valve) have a throttle shaft that is assembled into a bore which is machined transversely to the throttle bore of the carburetor. The valve is attached to the shaft so that it aligns with the throttle bore. As the shaft rotates the valve opens the throttle bore passage, allowing air to flow through the bore to the engine.

In conventional carburetors C, the throttle shafts TS are retained by using a single e-ring ER, positioned at the opposite side of the throttle shaft TS from the throttle return spring RS (FIGS. 1 and 2). Due to having only one retainer, the throttle shaft TS is allowed to move in the direction of the e-ring ER due to an axial force F1, which causes the throttle return spring RS to compress and tends to cause the throttle valve TV to collide with the side of the throttle bore TB (FIG. 3). Axial movement in the opposite direction due to an axial force applied by F2 is stopped by the e-ring ER.

Attempts to fix this problem have included installing collars on both ends of the throttle shaft. This solution tends to be costly to assemble and to manufacture.

It is desirable to provide an improved throttle retainer assembly that reduces or eliminates the drawbacks associate with conventional throttle shaft retainer systems and methods.

SUMMARY

The embodiments described herein provide a carburetor with throttle shaft retainer system. The throttle shaft retainer system employ a retainer member in the form of a retainer pin or retainer clip that is pressed into the body of the carburetor to engage a retainer groove formed about or partially about the circumference of the throttle shaft. The interaction between the retainer member and the retainer groove prevents movement in the axial direction of the throttle shaft.

With certain drilling and machined cuts to the throttle shaft, the retaining pin acts as the wide-open-throttle (WOT) stop when the throttle is rotated to a WOT position.

Further, objects and advantages of the invention will become apparent from the following detailed description.

BRIEF DESCRIPTION OF THE DRAWINGS

The details of the subject matter set forth herein, both as to its structure and operation, may be apparent by study of the accompanying figures, in which like reference numerals refer to like parts. The components in the figures are not necessarily to scale, emphasis instead being placed upon illustrating the principles of the subject matter. Moreover, all illustrations are intended to convey concepts, where relative sizes, shapes and other detailed attributes may be illustrated schematically rather than literally or precisely.

DETAILED DESCRIPTION

The present subject matter is not limited to the particular embodiments described, as those are only examples and may, of course, vary. Likewise, the terminology used herein is for the purpose of describing particular embodiments only, and is not intended to be limiting, since the scope of the present disclosure will be limited only by the appended claims.

The embodiments described herein with reference to the drawings provide a carburetor with a throttle shaft retainer system. The embodiments of the throttle shaft retainer system do not use the standard or conventional e-ring to position the throttle valve and throttle shaft, but rather employ a retainer member in the form of a retainer pin or retainer clip that is pressed into the body of the carburetor to engage a retainer groove formed about or partially about the circumference of the throttle shaft. The interaction between the retainer member and the retainer groove prevents movement in the axial direction of the throttle shaft.

Figure 1:
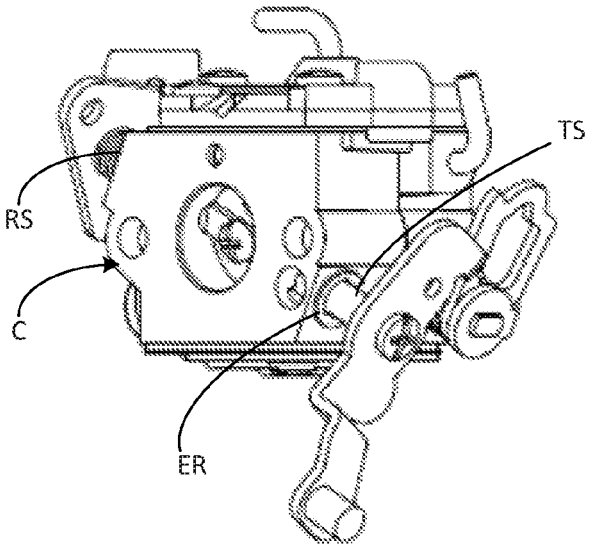
FIG. 1 is a perspective view of a carburetor with a conventional e-ring throttle shaft retainer.
Figure 2:
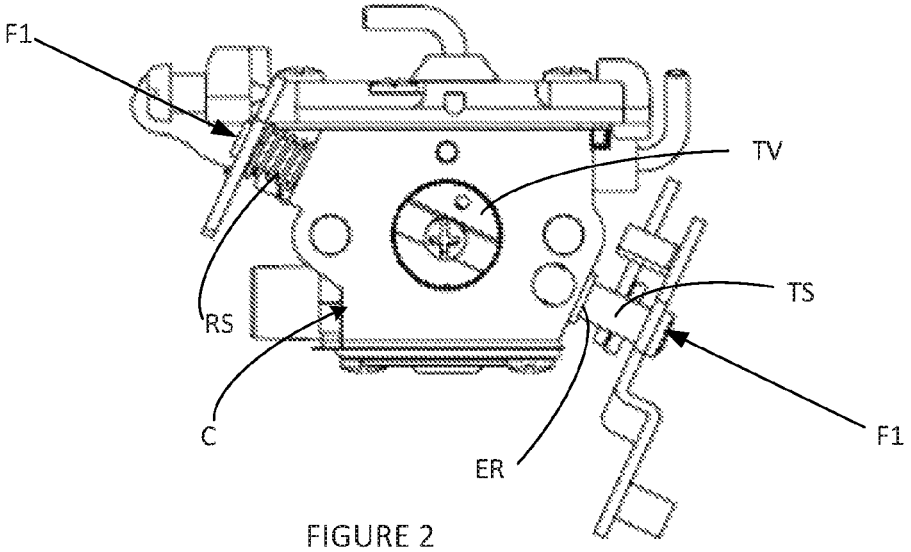
FIG. 2 is a plan view of the carburetor in FIG. 1 with axial forces applied to the throttle shaft.
Figure 3:
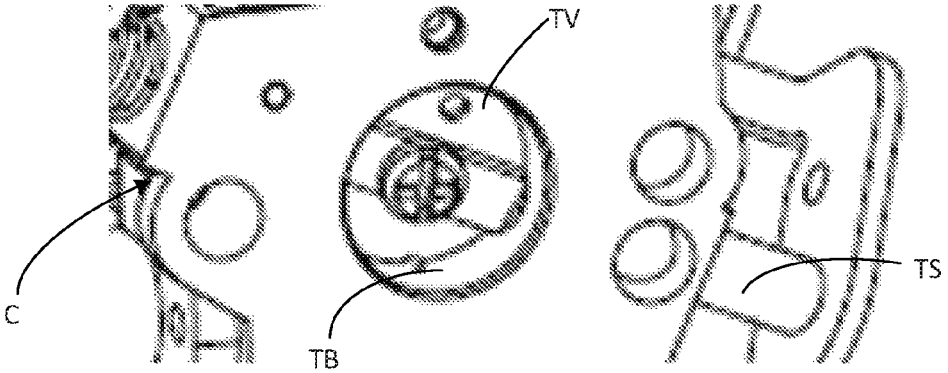
FIG. 3 is a partial perspective view of the carburetor of FIGS. 1 and 2 illustrating the effects of the axial forces applied to the throttle shaft.
Figure 4:
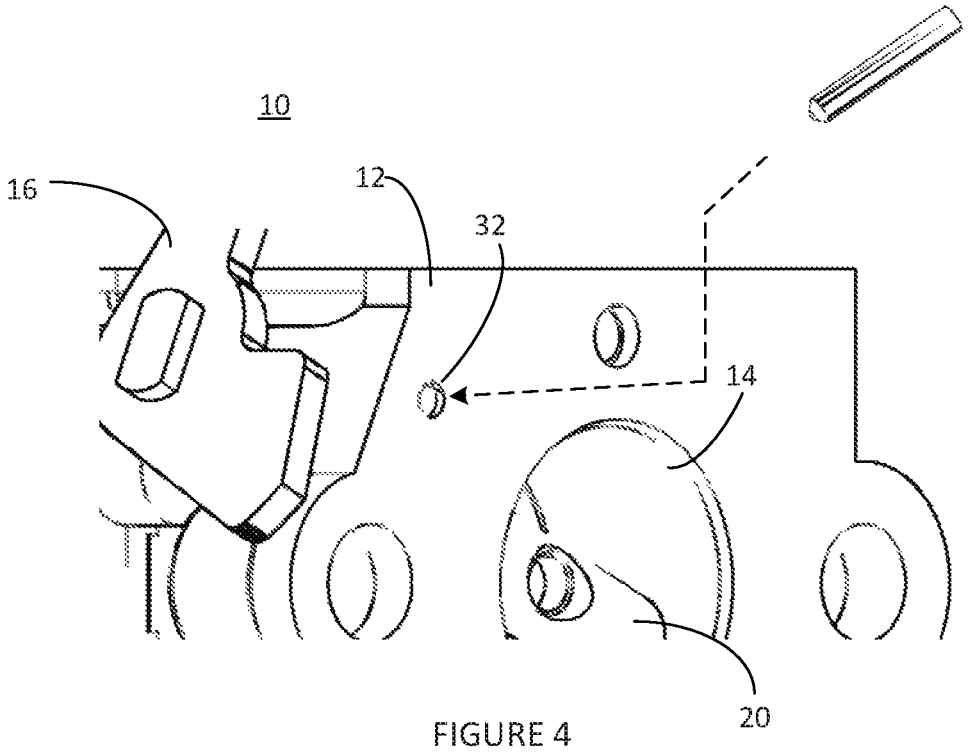
FIG. 4 is a partial perspective view of an exploded assembly of a carburetor including an embodiment of a throttle shaft retainer system.
Figure 5:
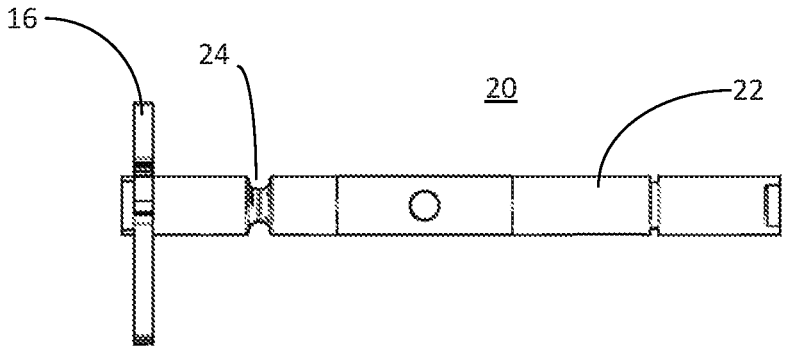
FIG. 5 is a plan view of a throttle shaft of the embodiment of the throttle shaft retainer system shown in FIG. 4.
Figure 6:
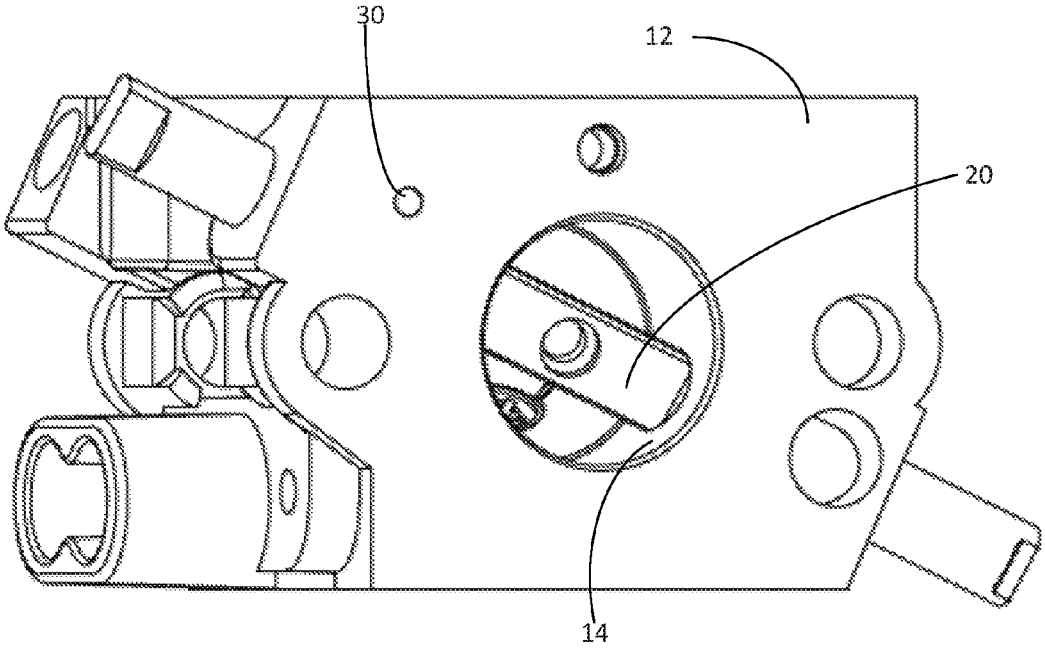
FIG. 6 is a fully assembled partial perspective view of the carburetor and throttle shaft retainer system shown in FIG. 4.

Referring to FIGS. 4 through 7, a carburetor 10 is shown to include a body 12, an air intake bore 14 extending there through, a throttle shaft 20 extending through a throttle shaft bore in the body 12 to transverse the air intake bore 14, and a throttle lever 16 coupled to a throttle return spring end of the throttle shaft 20. A butterfly valve (not shown) is mountable to the throttle shaft 20 and positionable in the air intake bore 14 as in conventional carburetors shown in FIGS. 1-3.

Figure 7:
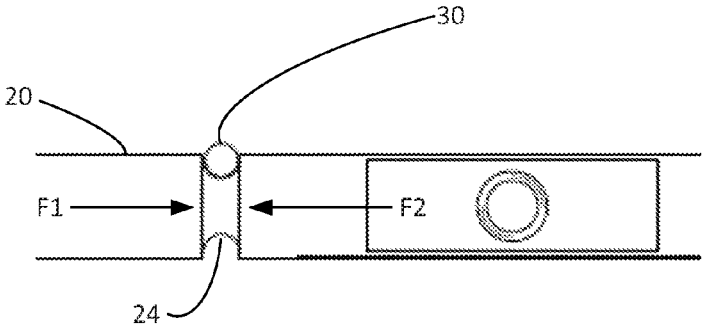
FIG. 7 is a plan view of the throttle shaft of the embodiment of the throttle shaft retainer system shown in FIG. 4 with a retainer pin shown positioned in a retainer groove formed in the throttle shaft.
Figure 8:
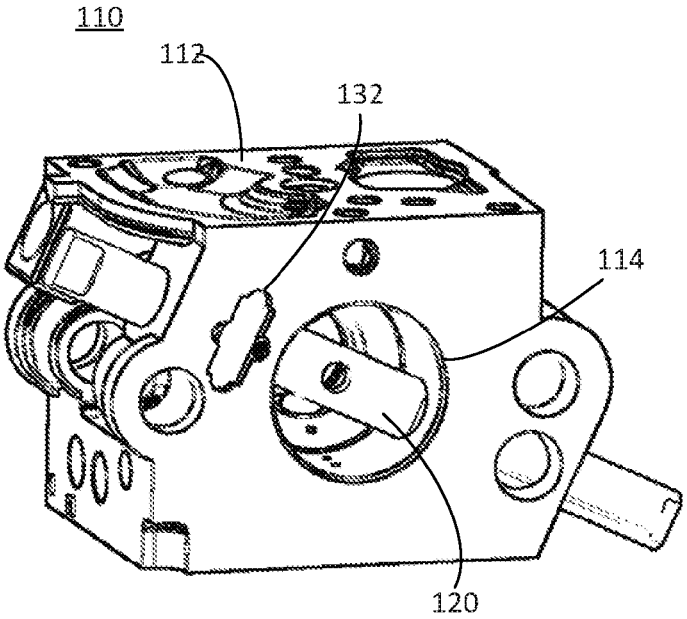
FIG. 8 is a partial perspective view of a carburetor including another embodiment of a throttle shaft retainer system.
Figure 9:
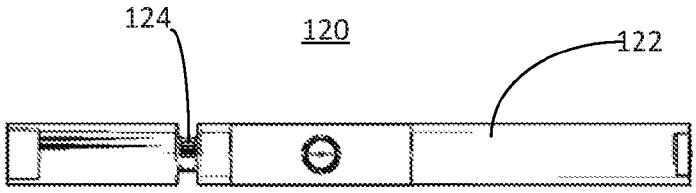
FIG. 9 is a plan view of a throttle shaft of the embodiment of the throttle shaft retainer system shown in FIG. 8.
Figure 10:
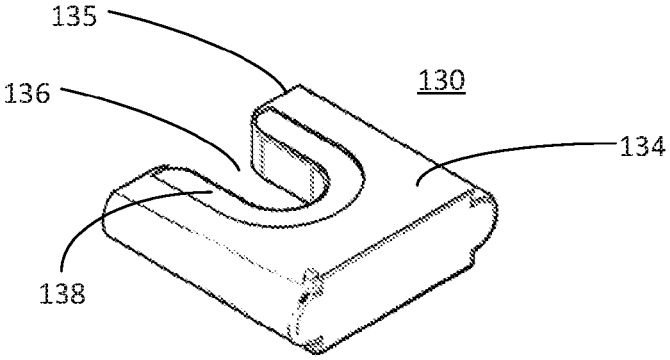
FIG. 10 is a perspective view of a clip having recess sized and shaped to engage a retainer groove formed in the throttle shaft shown in FIG. 9.
Figure 11:
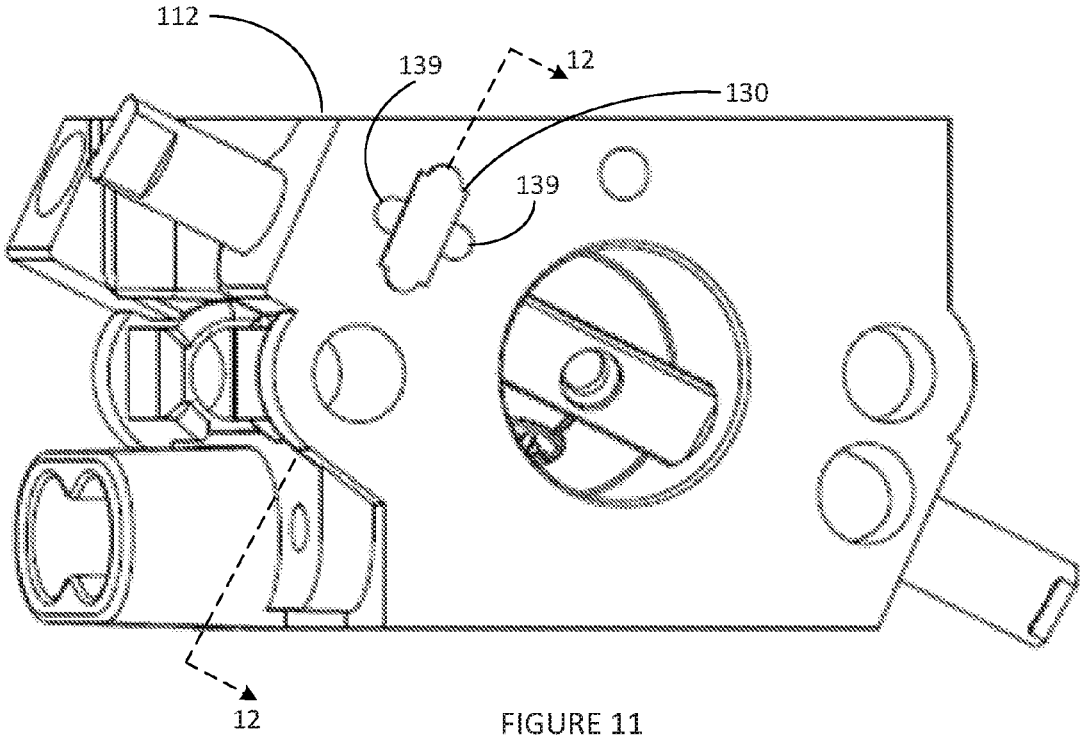
FIG. 11 is a perspective view of the clip in the carburetor.
Figure 12:
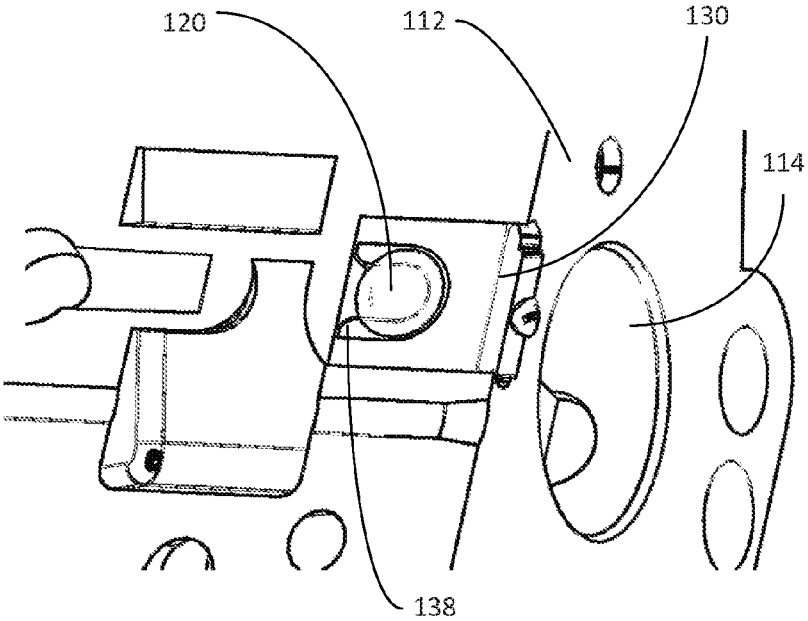
FIG. 12 is a partial sectional perspective view taken along line 12-12 in FIG. 11.
Figure 13:
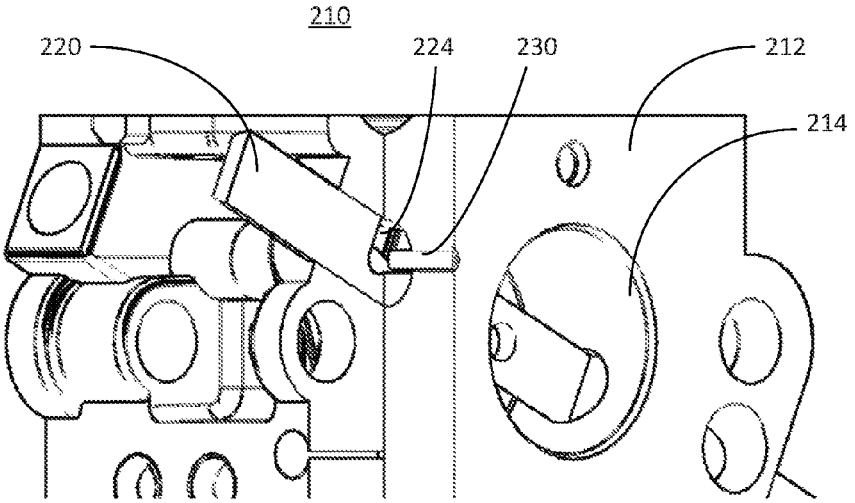
FIG. 13 is a partial perspective view of a carburetor including another embodiment of a throttle shaft retainer system.

The throttle shaft 20 comprises an elongate shaft member 22 with a retainer groove 24 machined about the circumference of the shaft member 22 adjacent the throttle return spring end of the throttle shaft 20 to which the throttle lever 16 is coupled. The groove 24 and a retainer pin 30, which is press fit into a retaining pin hole 32 formed in the body 12 and extending into the throttle shaft bore, are used to locate and securely position the throttle shaft 20 and throttle valve within the air intake bore 14. As shown in FIG. 7, axial movement of the throttle shaft 20, in either direction, due to axial forces, F1 and F2, is prevented due to the position of the retainer pin 30 and the retainer groove 24 in the shaft member 22.

The retainer pin 30, which is preferable made of steel, can be removed by pressing the pin 30 through the throttle shaft 20 and the body 12 to enable replacement of the throttle shaft 20 or carburetor maintenance.

This retainer system embodiment eliminates the need for e-rings or collars used in conventional systems.

Turning to FIGS. 8 through 12, a carburetor 110 is shown to include a body 112, an air intake bore 114 extending there through, and a throttle shaft 120 extending through a throttle shaft bore in the body 112 to transverse the air intake bore 114. A butterfly valve (not shown) is mountable to the throttle shaft 120 and positionable in the air intake bore 114 as in conventional carburetors shown in FIGS. 1-3.

The throttle shaft 120 comprises an elongate shaft member 122 with a retainer groove 124 machined about the circumference of the shaft member 122 adjacent a throttle return spring end of the throttle shaft 120. The groove 124 and a retainer clip 130, which is press fit into a retaining pin groove 132 formed in the body 112 and extending into the throttle shaft bore, are used to locate and securely position the throttle shaft 120 and throttle valve within the air intake bore 114. The retaining clip 130, which is preferably formed of plastic, has a generally square or rectangular shaped plate body 134 with a recess 136 extending inwardly from an edge 135 on an insertion end of the clip 130, and is sized and shaped to engage the retainer groove 124. The retaining clip 130 includes two parallel thrust surfaces, i.e., a top thrust surface 138 and a bottom thrust surface, extending about the recess 136. The thrust surfaces keep the shaft from moving in the axial direction due to axial forces (see axial forces F1 and F2 in FIG. 7).

The retainer clip 130 can be engaged via recesses 139 formed in the body 112 of the carburetor 110 to remove the clip 130 to enable replacement of the throttle shaft 120 or carburetor maintenance.

Referring to FIGS. 13 through 17, a carburetor 210 is shown to include a body 212, an air intake bore 214 extending there through, and a throttle shaft 220 extending through a throttle shaft bore in the body 212 to transverse the air intake bore 214. A butterfly valve (not shown) is mountable to the throttle shaft 220 and positionable in the air intake bore 214 as in conventional carburetors shown in FIGS. 1-3.

Figure 14:
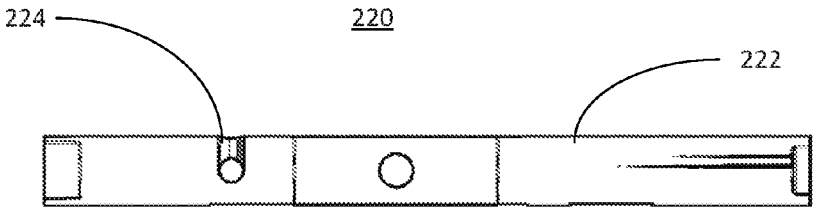
FIG. 14 is a plan view of a throttle shaft of the embodiment of the throttle shaft retainer system shown in FIG. 13.
Figure 15A:
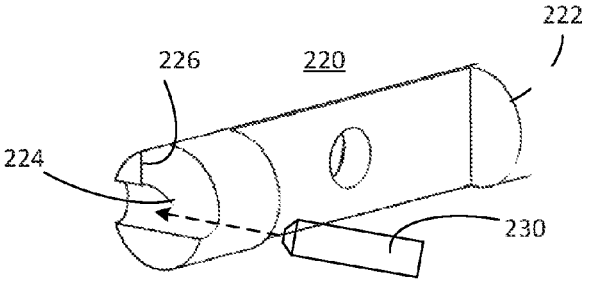
FIGS. 15A and 15B are exploded assembly and fully assembled perspective views of an assembly of the throttle shaft and retainer pin according to the embodiment shown in FIG. 13.
Figure 15B:
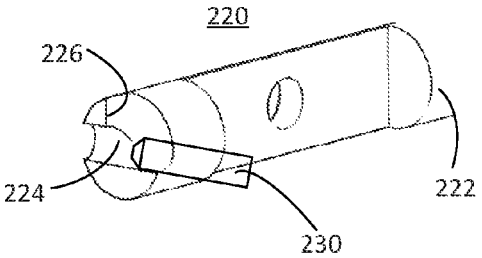
Figure 16:
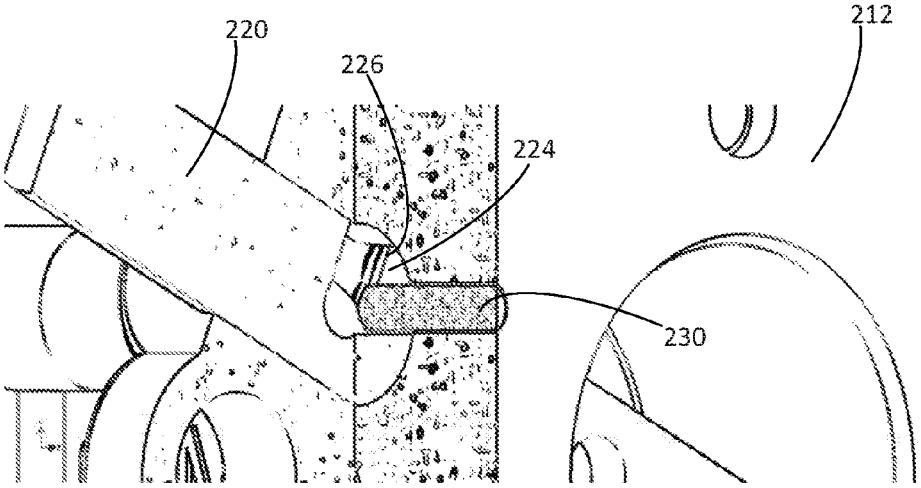
FIG. 16 is a fully assembled partial sectional perspective view of the carburetor and the throttle shaft retainer system according to the embodiment shown in FIG. 13 in an assembly/removal state.
Figure 17:
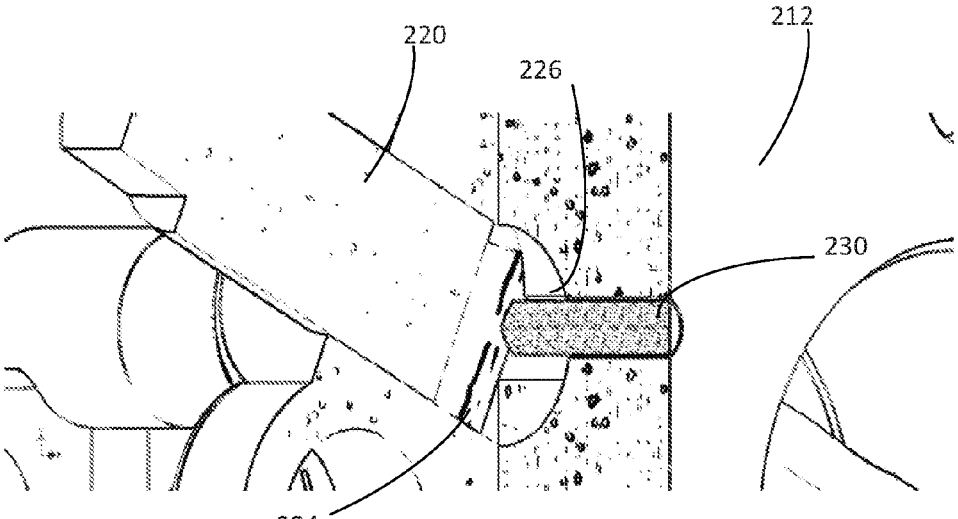
FIG. 17 is a fully assembled partial sectional perspective view of the carburetor and the throttle shaft retainer system according to the embodiment shown in FIG. 13 in a wide open throttle (WOT) state.
Figure 18A:
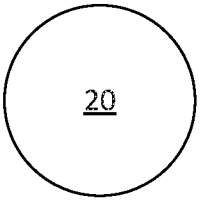
FIGS. 18A through 18E show cross-sectional shapes of the retainer pin of the embodiments shown in FIGS. 4 and 13.
Figure 18B:
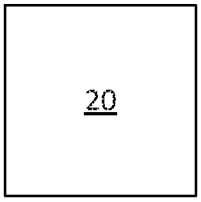
Figure 18C:
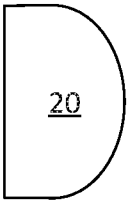
Figure 18D:
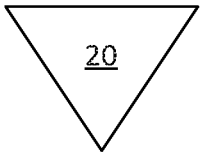
Figure 18E:
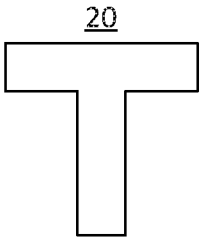

The throttle shaft 220 comprises an elongate shaft member 222 with a retainer groove 224 machined partially about the circumference of the shaft member 222 adjacent the throttle return spring end of the throttle shaft 220. The groove 224 and a retainer pin 230, which is press fit into a retaining pin hole formed in the body 212 and extending into the throttle shaft bore, are used to locate and securely position the throttle shaft 220 and throttle valve within the air intake bore 214. As shown in FIGS. 14, 15A and 15B, the groove 224 is machined about a quarter turn about the circumference of the shaft member 222 forming a wide-open-throttle (WOT) stop face 226. The pin 230 is insertable into the groove 224 to prevent axial movement of the throttle shaft 20 due to axial forces (see axial forces F1 and F2 in FIG. 7), and, as shown in FIGS. 16 and 17, to act as a WOT stop as the throttle shaft 220 rotates and the WOT stop face 226 abuts the retainer pin 230.

With certain drilling and machined cuts to the throttle shaft 220, the retaining pin 230 acts as the WOT stop when the throttle is at the WOT position. This pin 230 can also be driven through the throttle shaft 220 for replacement and/or carburetor maintenance.

As shown in FIGS. 18A through 18E, the cross-section shape of the retainer pins 30 and 230 can be one of a circular, square, D-, triangular or T-shaped.

All features, elements, components, functions, and steps described with respect to any embodiment provided herein are intended to be freely combinable and substitutable with those from any other embodiment. If a certain feature, element, component, function, or step is described with respect to only one embodiment, then it should be understood that that feature, element, component, function, or step can be used with every other embodiment described herein unless explicitly stated otherwise. This paragraph therefore serves as antecedent basis and written support for the introduction of claims, at any time, that combine features, elements, components, functions, and steps from different embodiments, or that substitute features, elements, components, functions, and steps from one embodiment with those of another, even if the following description does not explicitly state, in a particular instance, that such combinations or substitutions are possible. Express recitation of every possible combination and substitution is overly burdensome, especially given that the permissibility of each and every such combination and substitution will be readily recognized by those of ordinary skill in the art upon reading this description.

In many instances entities are described herein as being coupled to other entities. It should be understood that the terms "coupled" and "connected" (or any of their forms) are used interchangeably herein and, in both cases, are generic to the direct coupling of two entities (without any non-negligible (e.g., parasitic) intervening entities) and the indirect coupling of two entities (with one or more non-negligible intervening entities). Where entities are shown as being directly coupled together, or described as coupled together without description of any intervening entity, it should be understood that those entities can be indirectly coupled together as well unless the context clearly dictates otherwise.

As used herein and in the appended claims, the singular forms "a", "an", and "the" include plural referents unless the context clearly dictates otherwise.

While the embodiments are susceptible to various modifications and alternative forms, specific examples thereof have been shown in the drawings and are herein described in detail. It should be understood, however, that these embodiments are not to be limited to the particular form disclosed, but to the contrary, these embodiments are to cover all modifications, equivalents, and alternatives falling within the spirit of the disclosure. Furthermore, any features, functions, steps, or elements of the embodiments may be recited in or added to the claims, as well as negative limitations that define the inventive scope of the claims by features, functions, steps, or elements that are not within that scope.

What is claimed is:

1. A carburetor and throttle shaft retainer system assembly comprising a carburetor body, a throttle shaft positioned within a throttle shaft bore formed in the body, and a throttle shaft retainer system positioned within the body and preventing axial movement of the throttle shaft, wherein the throttle shaft retainer system includes an annular groove formed about the circumference of the throttle shaft, wherein the throttle shaft retainer system comprises a pin mounted within the body and positioned within the annular groove.

2. The carburetor of claim 1, wherein the pin has a cross-sectional shape comprising one of a circular shape, a rectangular shape, a triangular shape, a D-shape, and a T-shape.

3. The carburetor of claim 1, wherein the groove is shaped to include a stop face that when the throttle shaft rotates to a wide-open-throttle position the stop face abuts the pin.

4. The carburetor of claim 1, wherein the throttle shaft retainer system comprises a clip having a body and a recess extending inwardly from an insertion edge of the body, wherein the recess is shaped and sized to engage the groove in the throttle shaft.

5. The carburetor of claim 4, wherein the clip includes top and bottom thrust surfaces extending about the periphery of the recess.

* * * * *